United States Patent [19]

Cover

[11] 4,253,132

[45] Feb. 24, 1981

[54] POWER SUPPLY FOR WEAPON FOR IMMOBILIZATION AND CAPTURE

[76] Inventor: John H. Cover, 27129 Diamondhead La., Palos Verdes, Calif. 90274

[21] Appl. No.: 865,456

[22] Filed: Dec. 29, 1977

Related U.S. Application Data

[60] Continuation of Ser. No. 455,570, Mar. 28, 1974, abandoned, which is a division of Ser. No. 270,411, Jul. 10, 1972, Pat. No. 3,803,463, which is a continuation of Ser. No. 37,234, May 14, 1970, abandoned.

[51] Int. Cl.[2] ..... H05C 1/04

[52] U.S. Cl. ..... 361/232

[58] Field of Search ..... 361/232; 128/419 S, 128/404

[56] References Cited

U.S. PATENT DOCUMENTS

| | | | |
|---|---|---|---|
| 8,843 | 3/1852 | Sounenburg et al. | 361/232 |
| 2,805,067 | 9/1957 | Ryan | 361/232 |
| 3,523,538 | 8/1970 | Shimizu | 128/404 |

OTHER PUBLICATIONS

Med. & Biol. Engng., "A Simple Battery-Powered Stimulator for Aversion Therapy", vol. 6, pp. 445-446, 1968.

AIEE Technical Paper 43-134, "Effect of Frequency on Let-Go Currents", 1944.

*Primary Examiner*—William M. Shoop

[57] ABSTRACT

A weapon for subduing and restraining includes an electrical power supply. The magnitude and frequency of the electrical impulses delivered to the target provide energy in excess of 0.001 joules and ranges in effect from immobilizing to potentially "lethal" levels.

12 Claims, 15 Drawing Figures

FIG. 1
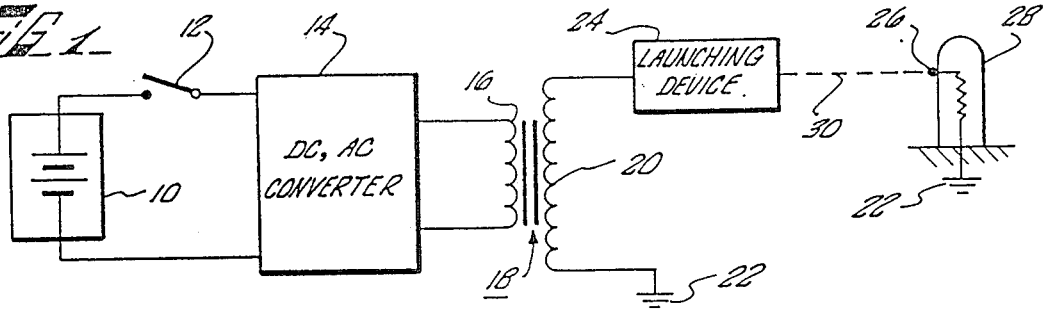
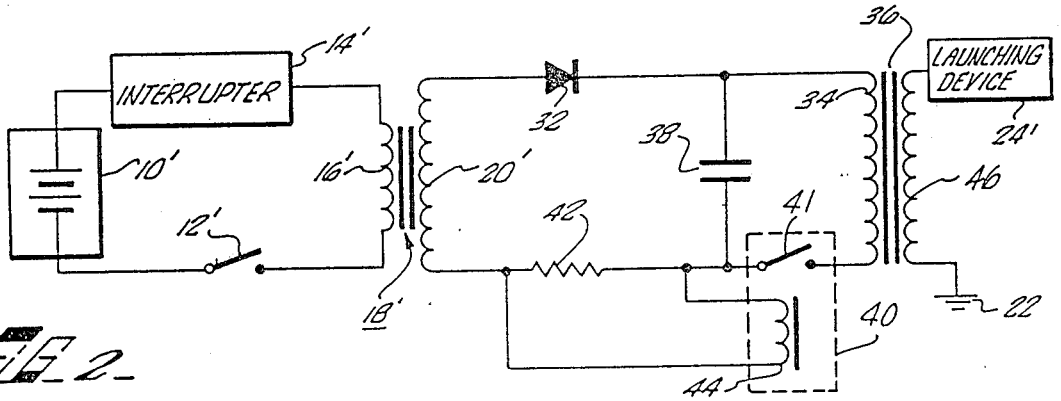
FIG. 2
FIG. 6
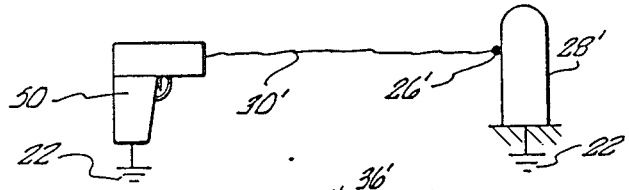
FIG. 4
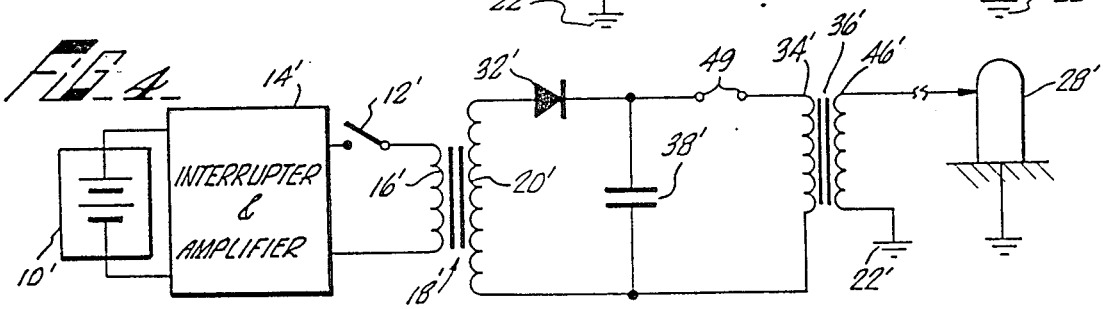
FIG. 3
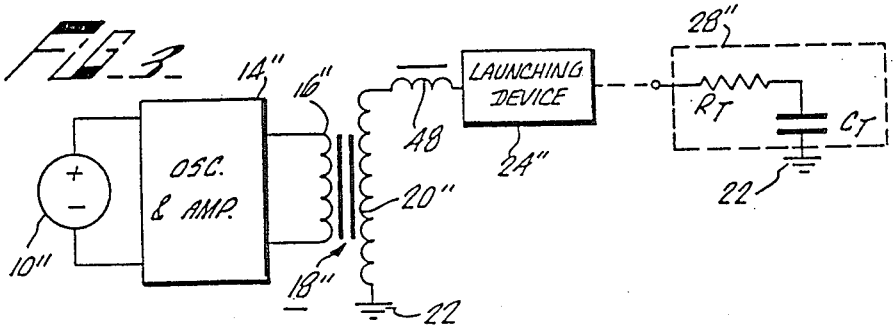

FIG. 7
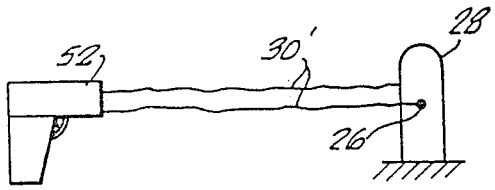
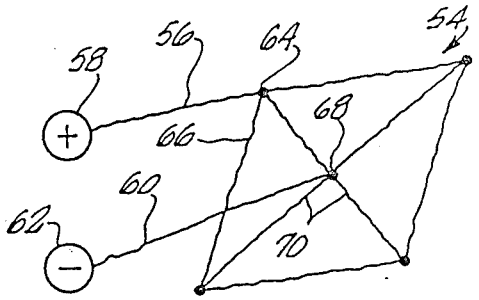
FIG. 8
FIG. 5
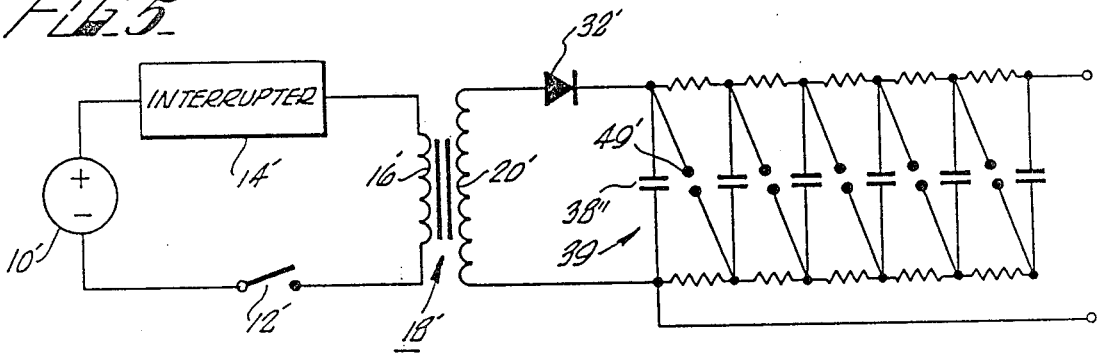
FIG. 14
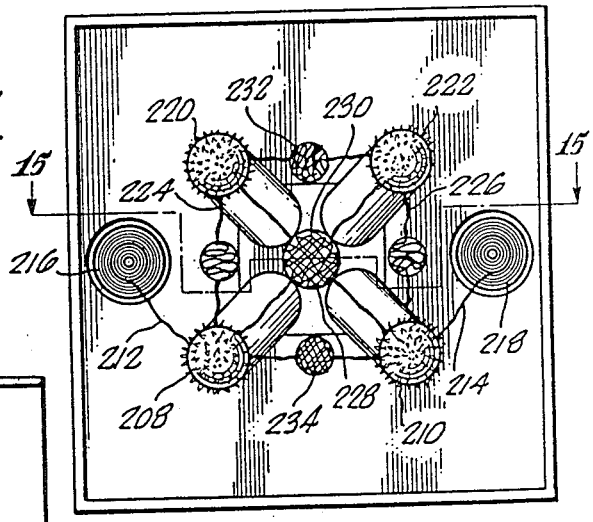
FIG. 15
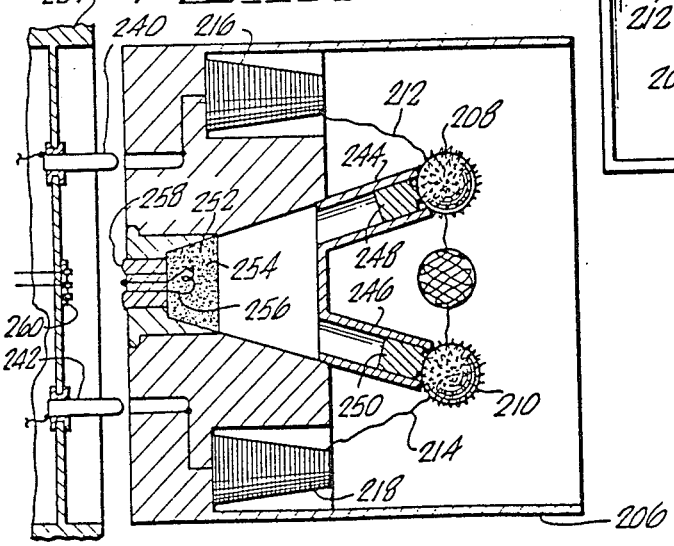

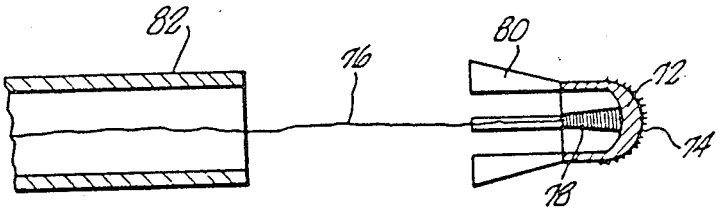
FIG. 9
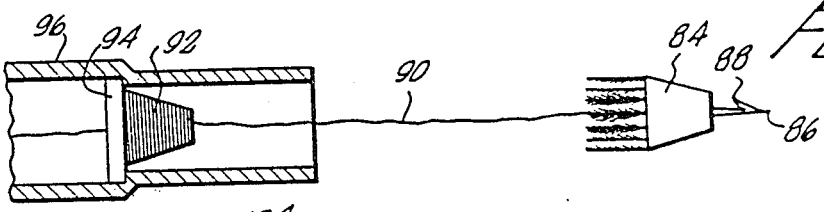
FIG. 10
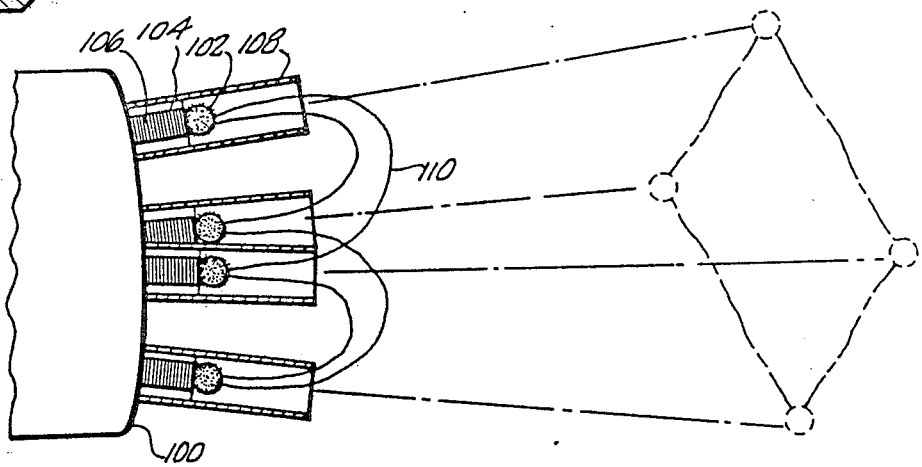
FIG. 11
FIG. 12
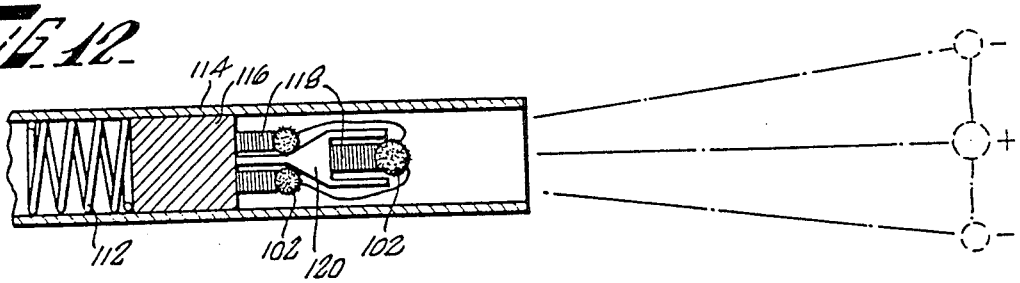
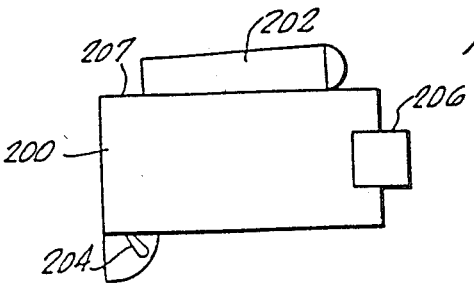
FIG. 13

POWER SUPPLY FOR WEAPON FOR IMMOBILIZATION AND CAPTURE

This is a continuation of application Ser. No. 455,570, now abandoned, filed Mar. 28, 1974, which is a division of application Ser. No. 270,411, filed July 10, 1972, now U.S. Pat. No. 3,803,463, issued Apr. 9, 1974, which, in turn, was a continuation of application Ser. No. 037,234, filed May 14, 1970, now abandoned.

The present invention relates to weapons and more particularly to an improved weapon capable of delivering electrical impulses to remote targets.

In 1852, Dr. Albert Soundenburg and Phillipp Rechten received U.S. Pat. No. 8,843, for "Electric Whaling apparatus," which taught a harpoon connected through a conducting cable to a "magneto-electric rotation machine." The machine was a simple, mechanically operated generator which had one terminal connected to the cable and a second terminal connected through the "copper bottom" of a "whale boat," to the ocean. As taught, a harpooned whale could be "electrocuted" by operating the generator, even though the harpoon wound might be superficial.

In 1952, Thomas D. Ryan applied for Letters Patent for "Electric Weapons," which matured into U.S. Pat. No. 2,805,067, on Sept. 3, 1957. In that patent, various otherwise lethal weapons of the past such as spears, arrows, and lances were provided with self-contained power supplies. These weapons, in addition to any physical trauma that could be inflicted upon a target, also applied high voltage electrical impulses, which, the patent states, are capable of producing either lethal or merely irritating effects.

These weapons had a source of power such as a battery, a transformer circuit and an interrupter, either a magnetic "chopper" or a spring-mass, oscillating system. The weapons were designed to deliver a series of high voltage shocking impulses to supplement the normal effect of such conventional, primitive weapons, which are primarily hand-held or hand propelled.

As of the data of the Ryan application, very little was known of the true physiological effects of electric currents on the living organism. Nonetheless, Ryan suggested that his device could produce varying results from fibrillation to severe muscle spasms, thereby immobilizing the victim. It is not clear that the disclosed circuits could, in fact, meet the object of the patent.

Dalziel and Lee, in an article published in the IEEE SPECTRUM of February, 1969, pp. 44–50, entitled "Lethal Electric Currents," smmarized their article in the IEEE Transactions of Industry and General Applications, Vol. IGA-4, pp. 467, 476, September-October, 1968, which reviewed the available data relating to the deleterious effects of electric shock, and reported on experiments that had been conducted. The authors discussed the effects of electricity as a function of voltage, current, frequency and duration.

Experiments on volunteers and research on animals tended to establish ventricular fibrillation as the most probable cause of fatalities attributed to "electrocution." Currents, if conducted through nerve centers, may arrest certain functions such as respiration for periods of time after the current has ceased. Of course, high currents can produce burns and irreversible damage to vital organs as a result of heat.

Dalziel and Lee studied physiological response as a function of applied currents and found a nonlinear relationship. At the lowest levels of magnitude, electric currents produce a "shock" and perhaps involuntary muscle movements. At a next higher level, increasing involuntary muscular contractions occur, and, with increasing currents, a loss of voluntary muscular control. There next occurs a magnitude of current, at which a subject cannot voluntarily overcome the contracting forces. The greatest current at which it is still possible to release a conductor using the muscles directly stimulated by the current is called the "let-go" current, which represents the threshold between "harmless" and "harmful" exposures.

Currents slightly in excess of the "let-go" current will "freeze" a subject to a circuit, so long as the current persists. Higher currents of substantial duration, either continuous or intermittent, can produce serious, potentially lethal effects, including ventricular fibrillation, paralysis, asphyxia and burns.

Yet other studies by the Underwriters Laboratory in 1939 dealt with the problem of establishing safety standards for electrically charged fences. These studies, published in Research Report No. 14, in December 1939, suggested as safe, pulsed "shocks" of prescribed magnitudes, if separated by recommended time intervals.

With the growing problems arising from the indiscriminate use of lethal weapons for the apprehension of criminal suspects, as well as for the control of crowds and mobs, new devices must be found which can immobilize and capture without inflicting serious or irreversible harm in the process. It would be desirable to have a compact, hand-held device that is capable of subduing without serious or permanent harm. Such a device would be invaluable for the self-protection of the private citizen, as well as an important element in the armamentarium of the armed forces and law enforcement agencies.

It has been found that there exists a range of electrical impulses, which when delivered to a human target can immobilize the target by inducing involuntary muscular contractions. These amounts of electrical energy generally exceed the minimum "let-go" currents but are in a range that is considered well below fibrillation levels. It has also been found that the desired currents can be delivered a substantial distance through a very fine, lightweight filament. At sufficiently high voltages, there need not be penetration of the skin to deliver the electrical impulse. Moreover, it has been found that brief, intermittent impulses of current can be just as, if not more, effective than continuous currents, with a substantial reduction in the power required.

It has been deemed desirable to provide a weapon which can utilize an otherwise harmless projectile and which does not require harmful penetration of the target. It is also desirable to have an electrical device the electrical energy to be delivered to the target can be controllably adjusted. Further, it has been deemed desirable to have a convenient, manually operated launcher capable of accurately delivering an otherwise harmless projectile over distances greater than those that most persons could achieve with any accuracy by throwing.

It is also desirable to have a small hand-held, self-contained weapon system capable of delivering a plurality of projectiles, with a conductive, filamentary connection as between a power supply in the launcher and the projectile.

According to the present invention, modern technology has been utilized to provide an extremely compact, electrical power supply capable of being packaged in a manually operable launcher, which, in combination with novel, relatively harmless projectiles, can deliver an electrical charge to a remote target with reasonably good accuracy.

In the several embodiments, the projectile or missile may be a fictile pellet, or may include a plurality of pellets connected by a mesh or net, which would be deployed upon launching. It is also possible to utilize a projectile of the type generally used in "air rifles."

In alternative embodiments, larger launchers of the "rifle" type can be utilized, and would contain a heavier duty power supply, more suitable for use by law enforcement or military personnel. The several embodiments can be provided in single or multiple "shot" versions.

The launcher and projectile are electrically connected by means of a fine, conducting fiber which can be coiled in the projectile and tethered to the launcher. Alternatively, the supply coil can be arranged to remain with the launcher and the projectile would deploy the fiber. Both techniques have counterparts in other fields such as the "spinning" reel or the two-wire, guided missile.

In other embodiments, the projectile can be propelled, by means of a spring, compressed air, or compressed $CO_2$. Explosive or pyrotechnic propellants may be employed, but would, if utilized, bring the device within the ambit of the various laws regulating "deadly weapons, " and might require registration by or permits of the user.

In accordance with the underlying theory of the present invention, there are two types of electrical current delivery systems. A first type of system employs a single wire and operates either in a conducting mode, wherein the ground or earth is used to complete the circuit between the power supply and the target or in a nonconducting mode which charges the target body to a predetermined voltage level, through the capacitive impedance of the body, thereby transmitting the requisite amount of current.

An alternative system utilizes a pair of wires constituting a current delivery and return path. In the two-wire system, a plurality of projectiles may be deployed, connected by nonconducting fibers to form a mesh or net which envelops the target. In this system, it is unnecessary for either the power supply or the target to be grounded. Sufficient current can be made to flow through the target to accomplish the desired results.

As a special embodiment of the single wire, nonconducting mode, a "resonant" circuit is provided which is "tuned" to the impedance of the target for a particular frequency. Such a resonant or tuned circuit can supply desired currents of lesser magnitude at lower frequencies to the target achieving the same physiological effects, but at substantial reductions in the power required.

Accordingly, it is an object of the present invention to provide an electrical power supply for generating electrical currents and for applying these currents to a target by means of a wire which is deployed using a launcher and projectile combination.

It is another object of invention to provide an improved protective device which applies a shocking and holding current to a target by a means of a wire carrying projectile.

It is yet another object of the invention to provide means for applying an electrical current to a remote location including a net trailing a conductive wire which is connected to and launched from a portable, hand-held power supply.

The novel features which are believed to be characteristic of the invention, both as to organization and method of operation, together with further objects and advantages thereof will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

FIG. 1 is a block-circuit diagram of a first embodiment of the invention in its broadest form, operating in a single-wire, conducting mode;

FIG. 2 is a block-circuit diagram of an alternative embodiment according to the present invention, modified to operate in a pulsed, conducting mode;

FIG. 3 is a block-circuit diagram of an alternative embodiment of a system operating in a single-wire, nonconducting, resonant mode;

FIG. 4 is a block-circuit diagram of a power supply similar to that of FIG. 2 but employing a spark gap discharge.

FIG. 5 is yet an additional alternative embodiment of a two-wire system utilizing a plurality of spark gaps and a bank of capacitors in the output circuit for voltage amplification;

FIG. 6 is a simplified representation of a delivery system according to the present invention, illustrating single-wire operation in the conducting mode;

FIG. 7 is a representational view of the system of the present invention, modified to operate as a two-wire system;

FIG. 8 is a representational view of a net for enveloping a target;

FIG. 9 is a side view of a "cockle burr" type projectile carrying the supply of filamentary, conductive wire;

FIG. 10 is a view of alternative projectile, a dart in which a supply of conductive wire is retained in the launching device;

FIG. 11 is a view of a launcher for deploying a plurality of projectiles, connected by an insulating fiber in a net;

FIG. 12 is a view of an alternative launcher employing a single barrel;

FIG. 13 is a side view of an alternative system including a flashlight and a replaceable "cartridge";

FIG. 14 is a front view of the "cartridge" of FIG. 13; and

FIG. 15 is a side sectional view of the cartridge of FIG. 14, taken along the line 15—15 in the direction of the appended arrows.

Turning first to FIG. 1, there is illustrated a typical circuit useful for operating either a single-wire or a two-wire system in the "conducting" mode. As shown, a power supply such as storage battery 10 is connected through a switch 12 to a DC-AC inverter unit 14. The output of the DC-AC inverter unit 14 is applied to the primary winding 16 of a transformer 18. The secondary winding 20 of the transformer 18 is connected at one terminal to ground, indicated by the conventional ground symbol 22 for single-wire operation. The other terminal is connected to a launching device 24, which physically propels a projectile 26 toward a remote target 28. In the two-wire configuration, the ground connection would be replaced by a connection to a second terminal in the launching device 24.

The projectile 26 remains connected, at all times, to the secondary winding 20 by a continuous, conducting wire or filament 30. The target 28, as illustrated, is represented by a finite resistance connected to ground 22. If the target is a human body, such a finite resistance exists between any point of contact and the ground upon which the target stands. Obviously, in the two-wire embodiment, a second conducting filament 30 (not shown) would also connect to the target 28.

In operation, according to one embodiment, the battery 10 may be a portable, light-weight, high energy power supply, which, through the inverter 14 and the transformer 18, produces AC voltage in the range of 20 to 30 KV.

Turning next to FIG. 2, there is shown an alternative circuit intended to operate in a pulsed mode. As shown, a power supply 10' is connected through switch 12' to a series circuit including an interrupter 14', such as an electromechanical chopper, and the primary 16' of a transformer 18'. The secondary winding 20' connects through a rectifying diode 32 to a second primary winding 34 of a second transformer 36.

A capacitor 38 is in parallel with the second primary 34, and a switching relay 40 has its switch 41 between the capacitor 38 and the second primary 34. The relay solenoid 44 is connected between the secondary winding 20' and the capacitor 38 and is connected in parallel with a current limiting resistor 42. A second, secondary winding 46 is connected at one end to the ground 22 and at the other end to a launching device 24'. In a two-wire system, both ends of the secondary 46 would be coupled to the launcher 24'.

In operation, a closure of the switch 12' completes the circuit through the interrupter 14' and the primary 16' of the transformer 18'. The interrupter 14' converts the DC of the battery 10' to an intermittent current, capable of transformation to higher voltages through the transformer 18'. The high voltage transformer output is rectified by the diode 32 and charges the capacitor 38. The "relay-relaxation circuit," including the capacitor 38 and the relay 40, discharges the capacitor 38 in pulses through the primary 34 of the second transformer 36. At the second, secondary winding 46, there is available approximately 20 KV, with pulses that can be as infrequent as three per second.

In a continuous mode of operation, as in the circuit of FIG. 1, these circuits will furnish currents in the 20 to 30 ma range. Alternatively, operating in a pulsed mode, as in FIG. 2 above, where the pulse repetition rates preferably range from two per second to ten per second, each pulse delivers no less than 0.01 joules and, preferably, approximately 0.5 joules to the target.

As a rule of thumb, it has been determined that the product of capacitance and voltage gives a figure of merit for the effectiveness of the pulsed power supply as against a living target. If the product, VC, of a single pulse is greater than $10^{-2}$ volt-farads, the shock can cause great harm and may even be lethal, even with a single shock. Values at $10^{-3}$ volt-farads are deemed adequate to immobilize a victim through muscular spasm. If maintained for any length of time, the victim will become exhausted or asphyxiated because of such involuntary muscular activity. VC values on the order of $10^{-4}$ volt farads, produce pain such that a victim may be incapable of rational reaction and would probably be inhibited from coherent, organized locomotion.

Experimental circuits have been built according to the present invention utilizing a 6-volt supply 10' in conjunction with a 46 to 1 turns ratio in the first transformer 18' and a 73 to 1 turns ratio in the second transformer 36. The capacitor 38 is selected to be 1.0 microfarads.

The output to the launching device 24' is therefore approximately 20,000 volts. However, because of the pulsed operation, the average power range is in the 1 to 10 watt level and in the preferred embodiment can be 2.5 watts. The power supply of FIG. 2 is designed to deliver, on the average, 20 KV pulses that provide 0.5 joules per pulse. This amount of energy is well below the levels considered dangerous by Dalziel and Lee, supra, and can be supplied by conventional dry cells.

Turning now to FIG. 3, there is shown an alternative embodiment operating in the single-wire, nonconducting, resonant mode. A power supply or battery 10" is connected to an oscillator-amplifier 14" which includes a switching device (not shown). The oscillator and amplifier 14" is connected to the primary winding 16" of a transformer 18". Similar to the circuit of FIG. 1, a secondary winding 20" has one end connected to ground 22 and at the other end is connected through an inductance element 48 to a launching device 24". As indicated in FIG. 3, the target 28" may be represented in the nonconducting mode as a series combination of a resistive and a capacitive element coupled to ground 22.

In operation, the battery 10" applying power across the oscillator-amplifier 14" provides oscillatory energy to the transformer 18" which produces a relatively high voltage output. Including an inductance element in the circuit tends to tune the circuit for minimum overall impedance at the operating frequency determined by the oscillator-amplifier 14". In experimental models, an oscillator operating at approximately 2 KHz, and with a capacitive load CT of approximately 100 pf, in the absence of an inductive element, approximately 30 KV are required to put 30 ma through the target. However, by adding an inductance 48 of approximately 7 henries, only 3 KV are necessary to provide the same 30 ma at the target.

In alternative embodiments of FIG. 3, appropriate circuitry for intermittent operation can be provided which further reduces the power requirements of the circuit. Alternatively, the circuit of FIG. 3 can be adapted for a two-wire operation in which case the ground connection would be unnecessary.

Turning next to FIG. 4, there is shown an embodiment for nonconducting, nonresonant intermittent operation utilizing a spark gap in conjunction with a capacitor. As shown in FIG. 4, the circuit of FIG. 2 may be employed except that the relay 40 and the elements associated therewith can be replaced by a spark gap 49.

In operation, the capacitor 38' is charged to a potential adequate to cause a discharge across the spark gap 49 which substantially discharges the capacitor 38'. The second transformer 36' efficiently couples this discharge pulse to the output circuits and to the target. The phenomenon of spark gap discharge is well known and the spacing as between the spark gap electrodes is selected to provide a discharge rate of from three to ten discharges per second.

Turning next to FIG. 5, there is shown yet an alternative embodiment in which the second transformer is replaced by a capacitor bank 39. As shown, the output circuits include, in addition to a rectifying diode 32, a plurality of capacitors 38" in parallel, separated by resistors and serially connected through spark gaps 49'. In one experimental embodiment, a bank of six capacitors 38" utilized in conjunction with a 6-volt power supply and a transformer having a turns ratio of 600 to 1 produced approximately 3 KV across each of the capacitors which serially discharged to produce an 18 KV output pulse. Obviously, such a circuit could be utilized either in a single-wire or two-wire systems.

Turning next to FIG. 6, there is shown in outline form, a simplified launcher 50 which has sent a projectile 26' to remote target 28'. As illustrated, the launcher is operated as a one-wire system and therefore requires a connection to ground 22. The target 28' is also coupled to ground 22 by its proximity to the ground. In operating embodiments of the present invention, 40 gage copper wire which has a diameter of 3 mils has a fusing current of approximately 1 ampere. The resistivity of such a filament is approximately 1 ohm per foot and has a weight of approximately 0.03 pounds per thousand feet. However, 100 yards of 40 gage copper wire would weigh approximately ½ ounce and would introduce a voltage drop of approximately 3 volts when conducting a 10 ma current.

In alternative embodiments, it is possible to utilize nonconductive filaments of even finer gage to which have been applied a conductive coating or plating. Any high tensile strength fibers could be utilized with an appropriate treatment to render it conductive. In some embodiments it is also desirable to provide an insulating coating over the conductive fibers.

Turning next to FIG. 7, there is shown an alternative launcher 52 which does not require a ground connection and which deploys at least two electrodes which may be projectiles 26', each connected to the launcher by a conductive filament 30'.

FIG. 8 illustrates a typical mesh or net 54 which may be deployed from the launcher to increase the probability of encountering the target. As shown, a first filament 56 is schematically indicated as being connected to a relatively positive terminal 58 at the launcher and a second filament 60 is indicated as connected to a relatively negative terminal 62. As shown, four peripheral projectiles 64 can be connected together with a conductive filament 66 so that the periphery of the net 54 is connected to apply the relatively positive potential. The central projectile 68 is connected to the relatively negative terminal 62 and is connected to the other projectile 64 with nonconducting filaments 70. When deployed to encounter a target, an electrical current will flow from the peripheral projectiles 64 through the target to the central projectile 68 thereby delivering the desired amount of electrical energy to the target.

It is obvious that other schemes may be devised to deliver the electrical currents to the target utilizing nondangerous projectiles with a high degree of confidence of encountering the target at various ranges.

Other combinations of projectile and conducting or nonconducting mesh connections are possible. For example, an alternative device might include a plurality of projectiles connected to the relatively positive conductor 56 and a plurality of projectiles would be coupled to the relatively negative conductor 60 and the several projectiles would be separately launched toward the target.

FIG. 9 illustrates one form of projectile 72 that may utilized. As shown, the projectile may be considered a "cockle burr" including a plurality of projecting conductive fibers 74 adapted to be entangled in clothing and electrically connected to a conductive filament 76 which is spooled on a bobbin 78 that is carried with the projectile 72. Stabilizing members 80 enable the projectile 72 to retain a reasonably accurate flight path. As illustrated, projectile 72 is launched from a barrel 82 and the conductive wire 76 is anchored, within the barrel to a plate (not shown) which is connected to the power supply. The projectile 72 can be propelled by any known means of propulsion including compressed air, compressed $CO_2$, a compressed spring or a pyrotechnic device.

Turning next to FIG. 10, there is shown an alternative projectile 84 which is a dart such as is used with compressed air or compressed $CO_2$ weapons. As shown, the dart 84 may include a point 86 with barb member 88 to enable a slight penetration of the target through clothing and the barb 88 enables the dart to become implanted and to be held in place. A conductive filament extends back to a bobbin 92 which is mounted in a "cartridge" 94 which is electrically coupled to the power supply. The dart 84 is normally held in the cartridge. When the pressure within the cartridge exceeds the restraints on the dart 84, the dart 84 is accelerated forward in a barrel 96. Obviously the cartridge 94 should be electrically isolated from the barrel 96 and the launcher to protect the user. The dart 84 coontinues to travel with the acceleration imparted to it and carries with it the conductive filament 90, which pays off the bobbin 92, substantially without friction or drag.

FIG. 11 illustrates a launcher 100 which is adapted to deploy a plurality of projectiles 102 each with a plurality of conductive projections adapted to hold to a target. A bobbin 104 containing a supply of conductive wire 106 is provided in each of the barrels 108 and the several projectiles 102 are interconnected by nonconducting filaments 110. Two of the projectiles can be connected to the relatively positive side of the power supply and two can be connected to the relatively negative side of the power supply. As shown in the dotted portion of the figure, the projectiles 102, when deployed, form a rhomboidal array which has a high probability of reaching a target.

FIG. 12 shows yet an alternative embodiment for deploying a plurality of projectiles 102, here three. As shown, a spring member 112 is mounted in a barrel 114 and pushes a piston member 116 upon which is mounted a pair of bobbins 118 and a conical, "ramp" member which also houses a bobbin 118. The ramp member 120 deflects the rear two projectiles 102 into a diverging path while the central projectile 102 is launched substantially in the direction of aim. The central projectile may be connected to the relatively positive terminal while the remaining two projectiles 102 are connected to the relatively negative terminal; and, when deployed, achieve the configuration shown in the dotted portion of FIG. 12.

Turning next to FIG. 13, there is shown one proposed configuration of a system 200 according to the present invention. This system, which is adapted to be hand-held, includes a flashlight element 202, a trigger switch 204 and a replaceable projectile cassette 206. The housing 207 is intended to be easily hand-held and contains the power supply and electrical circuits of the present invention. The flashlight element 202 can be utilized independently but it is intended to provide an aid to aiming in a darkened environment. Accordingly, the flashlight element 202 must be carefully aligned to be parallel with the launcher that is integral with the replaceable cassette 206.

As an additional design feature, it has been deemed appropriate to provide some form of alarm signal which indicates that the system is operable and ready to deploy projectiles. It is believed that such a signal would have a psychological effect and could add credibility to the warning of the user that the system might be employed.

FIG. 14 is a front view of the cassette 206 of FIG. 13 and shows the elements that would be contained in such a cassette. As illustrated, four projectiles are launched in a substantially rectangular net. Two of the projectiles 208, 210 are respectively connected to conductive filaments 212, 214 and to supply bobbins 216, 218. The other two projectiles 220, 222 are respectively connected through conductive elements 224, 226 to the first projectiles 208, 210. The fiber net 228 is coiled in a central receptacle 230 and the other connecting fibers 224, 226, 232 and 234 are each collected in a respective receptacle until the respective projectiles are deployed.

Turning finally to FIG. 15, there is shown in side-section view, the launching mechanism of a cassette 206. As shown, with appropriate male connectors 240, 242 which connect the power supply to the supply bobbins 216, 218. Two of the launching barrels 244, 246 are shown with the projectiles 208, 210 respectively mounted therein on piston members 248, 250, respectively. At the base of the barrel members, in a common chamber 252, a supply of pyrotechnic propellant 254 is provided. A filament 256 adapted to be incandescently heated for ignition, is electrically connected to a concentric electrode arrangement 258 in the base of the cassette 206 which mounts in contact with a matching electrode pair 260 in the launcher socket.

In operation, the electrodes 260 are energized which cause the wire element 256 to ignite the pyrotechnic charge 254 driving the pistons 248, 250 in the outward direction. The force imparted propels the projectiles 208, 210 in a diverging direction with a substantial forward velocity component. The projectiles 208, 210 diverge until restrained by the fibers 232, 234, 228 and the projectiles, as a group, then continue in the forward direction. Electrical currents are applied to the projectiles 208, 210 through the conductive wires 212, 214, respectively which are connected to the electrodes 240, 242.

Thus, there has been shown in several embodiments apparatus for applying electrical energy to a remote target. The power levels that are employed are intended to be below lethal levels and adequate to control and immobilize an attacker.

What is claimed as new is:

1. A power supply for apparatus for applying electrical energy to a remote target including conducting means for transmitting electrical energy to the target, the power supply comprising:

power supply means for generating, at an output terminal, electrical energy in discrete impulses of approximately 20 kilovolts at a rate of from 2 to 10 impulses per second with each impulse delivering from 0.01 to 0.5 joules and means coupling said output terminal to the conducting means for transmitting electrical energy from said power supply means to the target, whereby electrical energy no less than 0.01 joules can be applied to a remote target.

2. A power supply for apparatus for applying electrical energy to a remote target including conducting means for transmitting electrical energy to the target, the power supply comprising:

power supply means for generating, at an output terminal, electrical energy in descrete impulses of voltage greater than 18 kilovolts at a rate of from 2 to 10 impulses per second at an average power of from 1 to 10 watts and means coupling said output terminal to the conducting means for transmitting electrical energy from said power supply means to the target, whereby electrical energy no less than 0.01 joules can be applied to a remote target.

3. Apparatus for applying electrical energy to a remote living target that is conductively connected to a return ground, comprising:

a voltage generator remotely located from the target, producing at least one discrete, substantially unidirectional voltage pulse of peak amplitude greater than 5 kilovolts, containing from 0.01 to 0.5 joules, and pulse width less than 0.1 seconds, having two output conductors one of which is connected to the return ground; and unipolar contacting means connected to the ungrounded output conductor of said voltage generator for applying said voltage pulse to the living target, whereby an electrical discharge of immobilizing effect is transferred to the living target, employing the conductive connection of the target to the return ground as a return path for transfer of the pulse discharge.

4. The apparatus of claim 3 further comprising launching means at said voltage generator for projecting said contacting means toward the remote target.

5. The apparatus of claim 4 wherein said voltage generator further comprises a capacitive discharge circuit for producing the pulse of substantially unidirectional voltage.

6. The apparatus of claim 5 further comprising a step-up transformer for coupling said capacitive discharge circuit to said contacting means.

7. The apparatus of claim 3 wherein said voltage generator produces a series of discrete pulses at a repetition rate of from 1 to less than 20 per second.

8. Apparatus for applying electrical energy to a remote living target that is not conductively connected to a return ground but which is predominantly capacitively coupled thereto, comprising:

a voltage generator remotely located from the target, producing at least one discrete substantially unidirectional voltage pulse of peak amplitude greater than 5 kilovolts, delivering from 0.01 to 0.5 joules and of pulse width less than 0.1 seconds, having two output conductors one of which is connected to the return ground; and unipolar contacting means connected to the ungrounded output conductor of said voltage generator for applying said voltage pulse to the living target, whereby an electrical discharge of immobilizing effect is transferred to the living target, employing the capacitance of the target to the return ground as a return path for transfer of the pulse discharge.

9. The apparatus of claim 8 further comprising launching means at said voltage generator for projecting said contacting means toward the remote target.

10. The apparatus of claim 9 wherein said voltage generator further comprises a capacitive discharge circuit for producing the pulsed substantially unidirectional voltage.

11. The apparatus of claim 10 further comprising a step-up transformer for coupling said capacitive discharge.

12. The apparatus of claim 8 wherein said voltage generator produces a series of discrete pulses at a repetition rate of from 1 to less than 20 per second.

* * * * *